US006960074B1

(12) United States Patent
Donoso

(10) Patent No.: US 6,960,074 B1
(45) Date of Patent: Nov. 1, 2005

(54) SMOKE-LESS CANDLE FLAME EXTINGUISHING APPARATUS AND METHOD

(76) Inventor: Gertrude A. Donoso, 154 E. Wiser Lake Rd., Lynden, WA (US) 98264

( * ) Notice: Subject to any disclaimer, the term of this patent is extended or adjusted under 35 U.S.C. 154(b) by 0 days.

(21) Appl. No.: 10/458,105

(22) Filed: Jun. 9, 2003

Related U.S. Application Data

(60) Provisional application No. 60/386,450, filed on Jun. 7, 2002.

(51) Int. Cl.[7] ..... F23Q 25/00
(52) U.S. Cl. ..... 431/144; 431/146; 169/46; 169/54
(58) Field of Search ..... 431/144, 145, 431/146, 288, 289, 33, 35; 169/46, 54

(56) References Cited

U.S. PATENT DOCUMENTS

| | | | | | |
|---|---|---|---|---|---|
| 940,832 | A * | 11/1909 | Swoger | 431/144 |
| D157,249 | S | 2/1950 | Geerlings | |
| 3,775,037 | A * | 11/1973 | Sande | 431/144 |
| 4,138,211 | A | 2/1979 | Kampfer et al. | |
| D330,784 | S | 11/1992 | Zuffoletti | |
| D343,240 | S | 1/1994 | Kane | |
| D343,913 | S | 2/1994 | Kane | |
| 5,282,737 | A * | 2/1994 | Ray | 431/144 |
| D406,409 | S | 3/1999 | Rubino | |
| 5,971,081 | A * | 10/1999 | Stewart | 169/54 |
| 6,298,922 | B1 * | 10/2001 | Stewart | 169/46 |
| 6,305,928 | B1 | 10/2001 | Novak | |
| D453,862 | S | 2/2002 | Cormier et al. | |
| D454,232 | S | 3/2002 | La Vanier | |
| D454,233 | S | 3/2002 | Cousins | |
| 6,435,858 | B1 * | 8/2002 | Cormier et al. | 431/144 |

* cited by examiner

*Primary Examiner*—Jiping Lu
(74) *Attorney, Agent, or Firm*—Robert B. Hughes; Hughes Law Firm, PLLC

(57) ABSTRACT

A manually operated candle flame extinguishing apparatus where there is a pair of arm members having flame extinguishing surface regions where there is a layer of flame extinguishing material. The flame extinguishing material reacts to the heat of the flame to emit a gaseous substances that extinguishes the flame. In one embodiment, the flame extinguishing material comprises a mixture of a bonding agent and sodium bicarbonate, with the sodium bicarbonate releasing carbon dioxide into region of the flame.

20 Claims, 3 Drawing Sheets

SMOKE-LESS CANDLE FLAME EXTINGUISHING APPARATUS AND METHOD

RELATED APPLICATIONS

This application claims the priority of U.S. Provisional Application filed on Jun. 7, 2002, Ser. No. 60/386,450, entitled "Smoke-Less Candle Flame Extinguisher".

FIELD OF THE INVENTION

The present invention relates to the extinguishing of candle flames, and more particularly to an apparatus and method where the apparatus is manually operated and functions in a manner to extinguish the flame with little or no residual smoke emanating from the candle.

DESCRIPTION OF THE EMBODIMENTS

Figure 1:
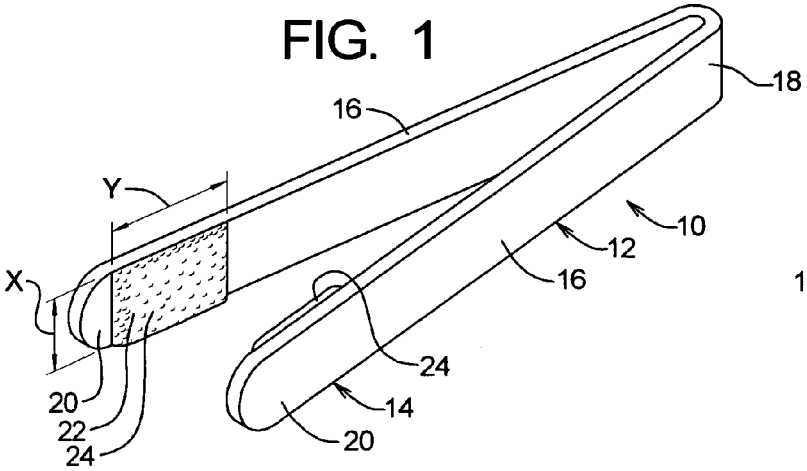
FIG. 1 is an isometric view of a first embodiment of the present invention.
Figure 2:
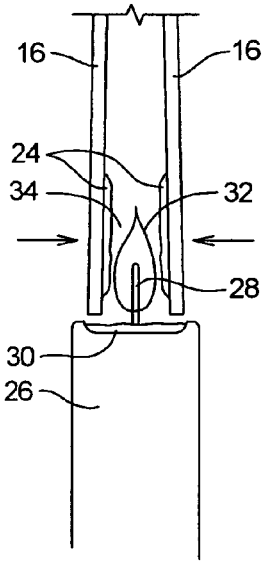
FIG. 2 is a side elevational view showing the lower portion of the apparatus of FIG. 1 being utilized to extinguish the flame of a candle.

Reference is first made to FIGS. 1 and 2, where there is shown a first embodiment of an apparatus incorporating the present invention. This apparatus 10 comprises a positioning section 12 and an extinguishing section 14. The positioning section 12 comprises a pair of arm members 16 which are joined together at upper end portions thereof at a juncture location 18 and extend from that juncture location at a moderate angle (e.g., five to ten degrees). The extinguishing section 14 comprises the two end portions 20 of the arm members 16 that are located at the end that is opposite to the location of the juncture location 18.

The two end portions 20 of the two arm members 16 each have a flame extinguishing surface regions 22, each of which in this particular embodiment has a width dimension (shown at "x" in FIG. 1) of about one-half inch, and a length dimension (shown at "y" in FIG. 1) of about one to one and one-half inch. These two flame extinguishing regions 22 each have a layer 24 of a flame extinguishing material which is characterized in that when the flame extinguishing material is in proximity to heat of a flame, it produces a flame suppressing gaseous substance.

Figure 1A:
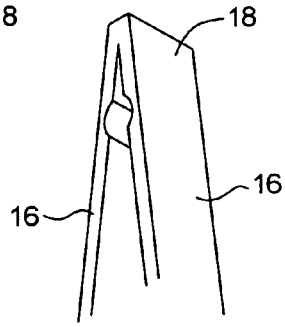
FIG. 1A is an isometric view of an upper portion of the positioning section of the embodiment of FIG. 1, and illustrating a particular configuration of a prototype where the positioning section comprises a pair of bamboo tongs.

In a working prototype of this first embodiment of the present invention the arm members 16 comprise a pair of bamboo tongs, where the tongs (i.e., the arm members 16) are two elongate flat members having a width dimension of about one-half inch, and with these two arm members 16 (tongs) being sufficiently bendable and resilient so that the tongs can be held in one hand and manipulated to move the two tongs together with reasonable ease (the upper end portion of these tongs is shown in FIG. 1A). When the apparatus 10 is operated to suppress the flame, the apparatus 10 will normally be held in a position where the arms 16 are vertically oriented, and with the end portions 20 being at a lower location and the juncture location 18 being at an upper location. Accordingly, in the following description, the apparatus 10 will be considered as being in this vertical position, and the terms "upper" and "lower" will be used accordingly, assuming that the apparatus is in the vertical operating position, as described above.

To describe the operation of the present invention, reference is made to FIG. 2. Let us assume that there is a candle 26 burning in a conventional manner so that there is a wick 28, for example, one-quarter inch long (or possibly up to one-half inch, or even up to one inch), with a small puddle of melted wax 30 being formed in a concave recess in the upper end of the candle. The arm members 16 of the apparatus 10 are grasped in a manner that the person can conveniently operate the apparatus 10, and the extinguishing section 14 in the form of the lower end portions 20 of the arm members 16 is positioned so that the flame is between the two flame extinguishing surface regions 22 of the arm end portions 20. Then, the arm members 16 are pushed from the position in FIG. 3 toward one another (as indicated by the arrows in FIG. 2) so that the two flame extinguishing surface regions 22 come closely adjacent to, or in contact with, the wick 28. When this occurs, the heat from the flame 32 immediately causes the flame extinguishing material 24 to emit carbon dioxide which displaces the atmospheric air in the flame extinguishing region 34 that is located between the two flame extinguishing surface regions 22, causing the flame to be extinguished.

The flame extinguishing material that forms the layers 24 in this first embodiment comprises a mixture of a glue and sodium bicarbonate mixed in a ratio of about two parts glue by the volume to three parts volume of powdered or granular sodium bicarbonate. When the layers 24 containing sodium bicarbonate ($NaHCO_3$) become positioned immediately adjacent to the flame, there is the following reaction, $2N_2$ $HCO_3$>$Na_2$ $CO_3$+$CO_2$+$H_2O$. The carbon dioxide smothers the flame, and also sodium bicarbonate absorbs heat when it decomposes to form $CO_2$, thus enhancing its ability to extinguish the flame. Also, the sodium bicarbonate releases free radicals which interrupt the combustion mechanism.

After the apparatus 10 is first used to extinguish the flame (or several times after the apparatus 10 has first been used to extinguish the flame), a the surface of the flame extinguishing material turns to a gray color which would indicate a slight depletion of the sodium bicarbonate closely adjacent to the surface. It has been found that the apparatus of the present invention can be used repeatedly (i.e., for several hundred flame extinguishing operations) and still be functioning quite satisfactorily in extinguishing the flame. However, eventually the sodium bicarbonate will become sufficiently depleted so that it would be necessary to replace the layer 24 of the flame extinguishing material. It has been found that the residual material which remains on the flame extinguishing surface regions 22 is sufficiently soluble to water so that this removal of the material could be readily accomplished. Then, a second of the flame extinguishing material could be applied in the manner described above, and as soon as the glue cures so that the material layer 24 becomes hard, the apparatus 10 can again be used.

To discuss further the flame extinguishing material 20, sodium bicarbonate is desirably used in this first embodiment since it is so readily available, relatively expensive, and effective. However, it is to be understood that other materials could be used. The flame extinguishing material should be non-toxic to prevent the emission of gaseous substances that would be environmentally harmful or harmful to a person's health. Candidates for other suitable flame extinguishing materials would be, for example, potassium bicarbonate, calcium carbonate, and potassium carbonate.

The bonding agent (glue) which is used in this first embodiment is a polyvinyl acetate based adhesive with no hazardous ingredients. This may comprise propylene glycol, $CH_3CHOHCH_2OH$ (having a Chemical Abstract Surface Number 57-55-6).

It is to be understood, however, that a variety of bonding agents and mixtures thereof could be used, and these should be non-toxic. However, since it would be well within the scope and skill of the art for others to apply different types of bonding agents and find those which give expected results, these will not be discussed in detail herein.

Also, with regard to the ratio of components in the flame suppressing material, a combination of two parts sodium bicarbonate to one part bonding agent provides a thicker paste, but one is still usable. Also, a ratio of one-to-one tends to be more liquid, but still functions satisfactorily.

The bonding agent and the flame suppressing agent can be mixed in a conventional manner, such as being placed together in a container and mixed with a stirring rod or other type of mixing device. This forms a paste which is applied on the flame extinguishing surface regions 22. It has been found that by depositing a layer of the flame suppressing material of about one-sixteenth to an inch thick is satisfactory. After this paste has hardened, then the apparatus 10 is ready to be used.

With regard to the dimensions of the layer 24 of flame suppressing material on two flame extinguishing surface regions 22, the width dimension is desirably at least one-half inch wide. It could have a width as low as one-quarter inch and it will function adequately in extinguishing the candle flame of a small votive candle. However, there is less margin of error in proper placement. Also, the width of the region 20 and the flame extinguishing material 24 could be increased to, for example, three-quarter inch or even one inch or more, and this may be desirable, for example, where the wick is somewhat longer so that the wick bends laterally outwardly. Also, if there is a large candle that burns in such a way that there is a rather substantial flame, then the width dimensions could be increased yet further.

With regard to the vertical dimension of the flame extinguishing surface region 22 along with the flame extinguishing material 24, the height dimension should be at least approximately one-half inch, three-quarter inch, or one inch. In some instances, the person who uses the candle does not always keep the wick at the desired length (e.g., about one-quarter inch), and in this instance the flame may be extending further up a longer wick. In these instances, the height of the flame extinguishing material 24 could be as great as 1¼ inch, 1½ inch, 1¾ inch, 2 inches, or beyond this to as great as three or four inches. This length could be increased even to a greater height dimension, but in general the combustion gases from the flame that could create this smoke would not be traveling that high, so that the extra flame extinguishing material of the layers 24 would not be necessary.

Figure 3:
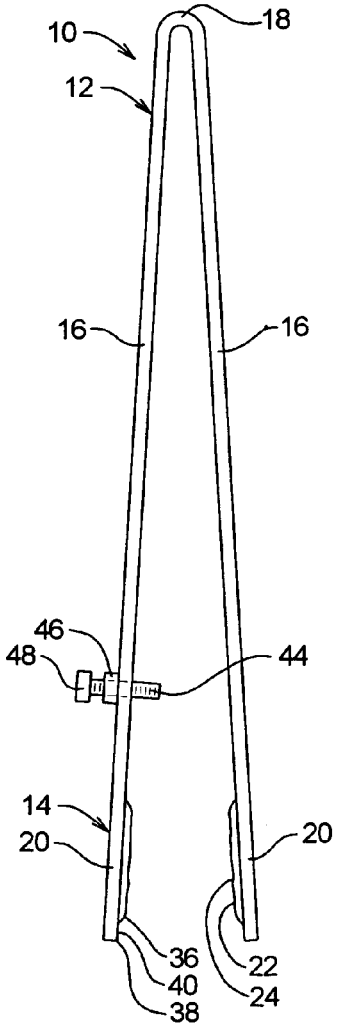
FIG. 3 is a side elevational view of the apparatus of FIG. 1 in a pre-operating open position, and further illustrating a spacing device.

With regard to the location of the flame extinguishing material 24 on the flame extinguishing surface region 22, as shown in FIG. 3, the lower edge 36 of the flame extinguishing material 24 is located a short distance upwardly from the lower end edge 38 of the arm member 16, so that there is a very lower edge portion, possibly as great as one-quarter inch or possibly one-half inch portion (this being indicated at 40 which does not have the flame extinguishing material 24 thereon). The reason for this is that the person who is operating the apparatus 10 may for convenience move the apparatus downwardly until the lower end edges 38 engage the solid upper surface of the candle which is slightly below the puddle 30 of molten wax. Therefore, this very lowermost arm portion 40 would become covered with the wax, and thus would not function effectively as a fire suppressant if it were exposed to the flame. For this reason, the inwardly facing surface portion of this lower most arm portion 40 would not have the fire retardant material 24 placed thereon. When the lower-most edge of the members 20 are dipped down into the liquid wax and the members 20 are raised out of the wax, the wax should immediately be wiped off so that it would not accumulate.

In the actual operation of the present invention, it has been found that by moving the two flame extinguishing surface regions 20 together and holding them in the operating position in contact with, or closely adjacent to, the wick 28 for three to five seconds, the flame can be totally extinguished with no noticeable smoke or very little noticeable smoke. However, a period of only about one second is still reasonably satisfactory, even though it may produce a small amount of smoke, but this rather small amount of smoke is a small fraction of smoke that would result by simply blowing out the candle.

EXAMPLE

Several candles seven inches tall and 3 inches in diameter were lit, and were permitted to burn for a sufficiently long time so that the wick had already burned down into the candle three inches when the testing began and several different configurations of the testing apparatus were used. All of these were bamboo tongs, as described previously in this text, but ranged in length (i.e., total length from six inches, eight inches, ten inches, to twelve inches). For the very large candles, twelve inch long bamboo tongs were used and the layer 24 of flame extinguishing material 24 was three inches in vertical length and even as high as four inches. This was quite satisfactory in extinguishing the flame with very little smoke. However, in using six-inch tall bamboo tongs, these were too short to conveniently reach down into the wells of these larger candles, and yet avoid the person's hand being exposed to too much heat. In general, the use of the twelve-inch tongs with the height of the layer 24 of the flame extinguishing material being two inches (or sometimes higher), turned out to be useful for very large candles, but for smaller candles the smaller length tongs could be comfortably and effectively used. In all instances, either no visible smoke resulted, or only a small trace of smoke.

Figure 4:
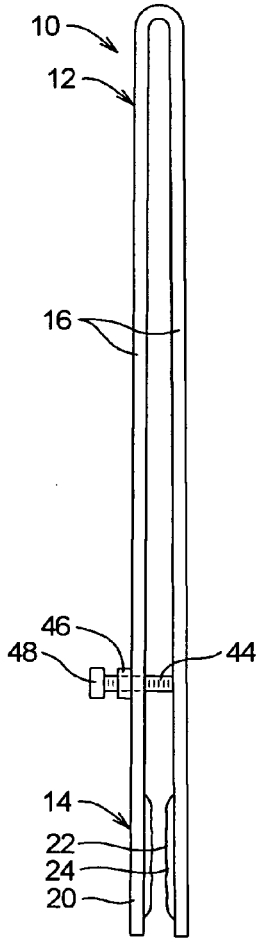
FIG. 4 is a view similar to FIG. 3, but showing apparatus in its operating position with the two layers of flame extinguishing material closely adjacent to one another.

In FIGS. 3 and 4, the apparatus 10 is shown with the addition of a positioning screw 44 which is threadedly mounted in a nut 46 that is joined to one of the arms 16. The head 48 of the screw can be turned to adjust the position of the screw 44. In FIG. 4, the two arms 16 are shown being moved together, with the two layers 24 of flame extinguishing material being positioned a short distance away from one another.

Figure 5:
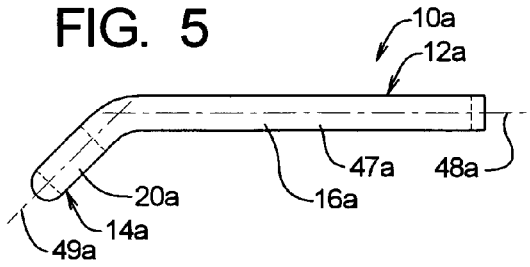
FIG. 5 is a side elevational view of a second embodiment of the present invention.

FIG. 5 shows a second embodiment of the present invention, and components of the second embodiment which are similar to those of the first embodiment will be given like numerical designations with an "a" suffix distinguishing those of the second embodiment.

In the embodiment of FIG. 5, the positioning section 12*a* has its two arms 16*a* making an angle with the flame suppressing end portions 20*a* of about 135 degrees. Thus, when the positioning section 12*a* is grasped by the person with the flame suppressing end portions 20*a* being vertically oriented, the person's hand is positioned so as not to be vertically aligned over the flame.

To explain this further, the positioning section 12 can be considered as having a hand gripping portion 47*a*, which in this particular embodiment would be at approximately a central location of the two arm members 16*a*. The positioning section 12 can be considered as having a positioning axis 48*a* which extends along the length of the positioning section 12*a*. Also, there is a flame extinguishing alignment axis 49*a* which extends in a lengthwise direction along the extinguishing section 14*a*, which is in the same direction as the lengthwise dimension of the layer of flame extinguishing material which is located thereon. Thus, when the apparatus 10*a* is in use, the members 20*a* of the flame extinguishing section 14 will aligned so that the flame extinguishing alignment axis 49*a* is vertically aligned on opposite sides of the flame 32. Since the positioning axis 48*a* is angled relative to the flame extinguishing alignment axis 49*a*, the hand gripping portion 47*a* is positioned laterally of the vertical aligned axis 49*a* so as to be spaced laterally from the rising hot gases emitted by the flame 30.

Figure 6:
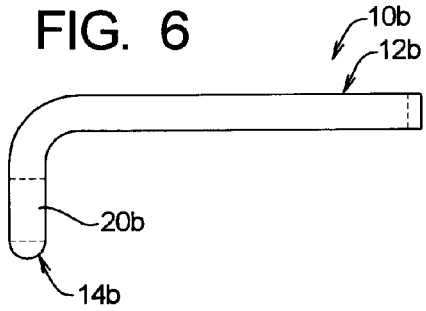
FIG. 6 is a view similar to FIG. 5, showing a third embodiment of the present invention.

In FIG. 6, a third embodiment is shown, and this is has "b" suffixes distinguishing components of this third embodiment from the earlier embodiments. This arrangement in FIG. 6 is similar to that shown in FIG. 5, except that the positioning section 12*b* is at a right angle to the alignment of the flame extinguishing end portions 20*b*.

Figure 7:
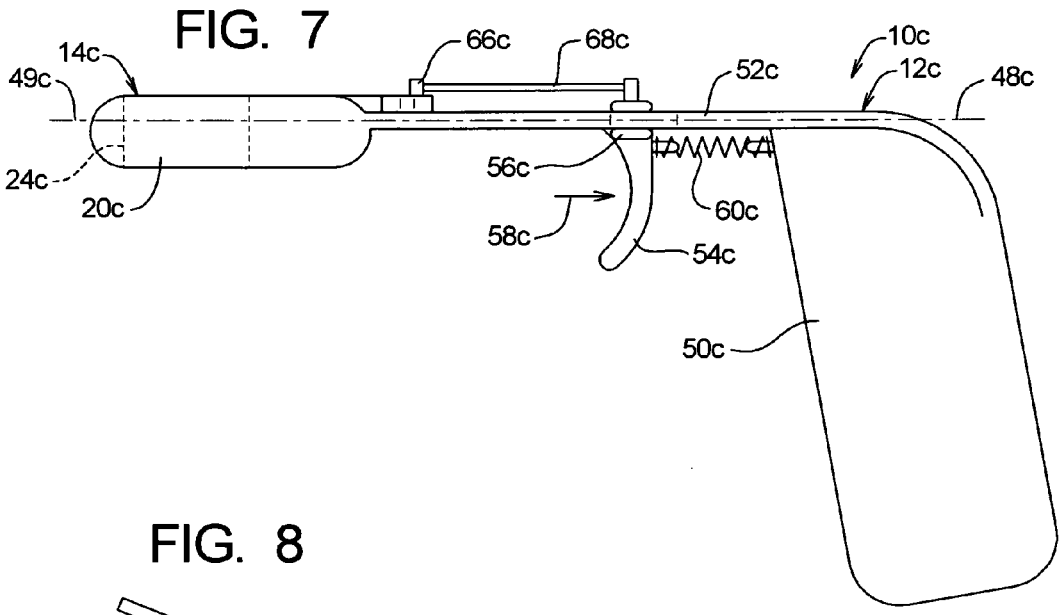
FIG. 7 is a side elevational view of a fourth embodiment of the present invention where the positioning section comprises a pistol grip.
Figure 8:
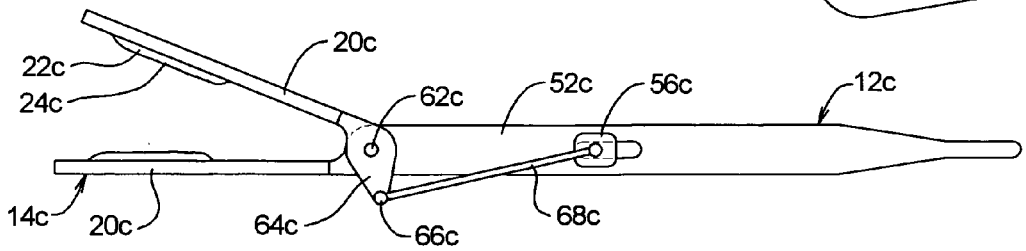
FIG. 8 is a top plan view of the fourth embodiment of FIG. 7 in its open non-operating position.
Figure 9:
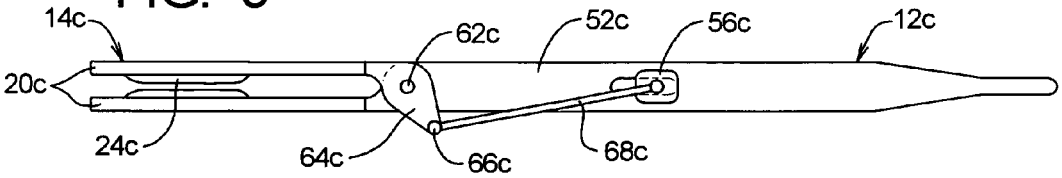
FIG. 9 is a view similar to FIG. 8, but showing the fourth embodiment in its operating position.

FIGS. 7, 8, and 9 show a fourth embodiment 10*c*, where the positioning section 12*c* is in the form of a pistol grip having a handle 50*c* which can be manually grasped, and a horizontally aligned rod member 52*c*. A trigger 54*c* is slide mounted at 56*c* to the rod member 52 so that the trigger 54*c* can be retracted in the rearward direction as indicated by the arrow 58*c*. A compression spring 60*c* is provided to urge the trigger member 54*c* in a forward direction away from the hand grip 50*c*.

The flame extinguishing section 14*c* comprises a pair of end members 20*c*, each of which has the flame extinguishing region 22*c* with the layer 24*c* of the flame suppressing material. One of the end members 20*c* is fixedly connected to the rod 52*c*, and the other end member 20*c* is pivotally mounted at 62*c* at a forward end of the rod 52*c*. An actuating finger 64*c* is fixedly attached at the pivot end of the moveable end member 20*c*, and another portion of the end of the finger 64*c* is connected at 66*c* to a positioning strut 68*c*. The spring 60*c* pushes the trigger 54*c* to its forward position, so that the strut 68*c* urges the moveable arm member 20*c* to its open position, as seen in FIG. 8.

In operation, the rod member 52*c* is vertically aligned, and the two flame suppressing end members 20*c* are placed around the candle flame as shown in FIG. 2. Then the trigger 54*c* is pulled to move the two members 20*c* together, as seen in FIG. 9.

It is to be understood that the two end members 20*c* could be reconfigured from the position in FIG. 7 so that the flame extinguishing alignment axes 49*c* of the end members 20*c* would be aligned at an angle with the positioning axis 48*c*, as in FIGS. 5 and 6. Then, the two arms that extend outwardly from the pivot location 62*c* would be slanted downwardly. In this instance, in the operating position, the pistol grip 50*c* would be held in more vertical orientation, and the rod 52*c* would be slanted from a vertical orientation.

Figure 10:
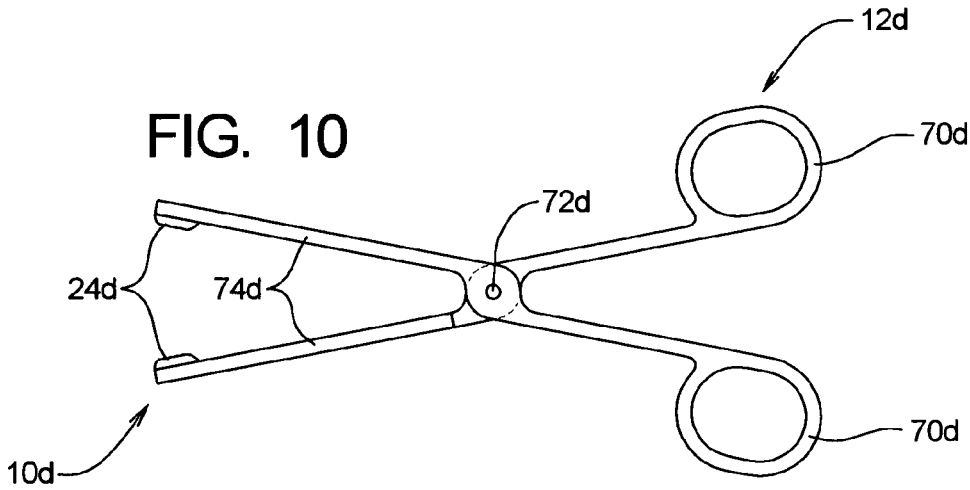
FIG. 10 is a view similar to FIG. 8, showing the fifth embodiment of the present invention.

FIG. 10 shows a fifth embodiment of the present invention where the apparatus 10*d* has a scissors configuration, where the positioning section 12*d* comprises two handle portions 70*d* of the scissors which join at a central pivot location 72*d*. The two operating end portions 74*d* of the scissors extend horizontally and are spaced apart from one another, and the two flame extinguishing end portions 20*d* (having their layers 24*d* of the flame extinguishing material) extend at right angles downwardly from the end portions 74*d*. Thus, the two handle members 72*d* can be held horizontally so that the person's hand is away from the flame.

Figure 11:
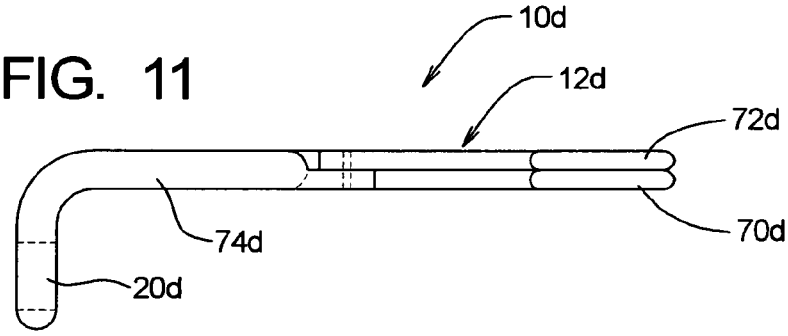
FIG. 11 is a side elevational view of the fifth embodiment of FIG. 10.
Figure 12:
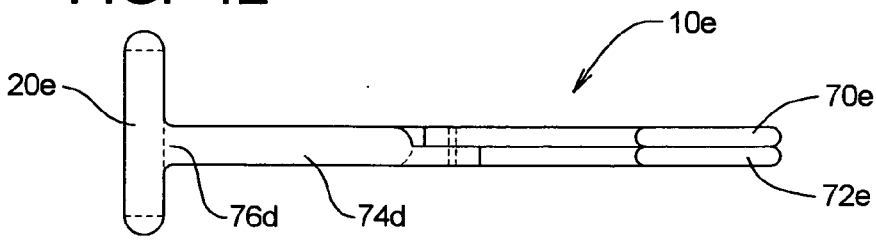
FIG. 12 is a view similar to FIG. 10, but showing a sixth embodiment.

The sixth embodiment of the present invention is shown in FIG. 12. FIG. 12 is taken from the same view as FIG. 11, and the apparatus 10*e* of the sixth embodiment has the same scissors configuration as shown in FIG. 10 showing the fifth embodiment. Accordingly, there are the two handle sections 70*e* and 72*e* along with the two operating ends 74*d*. However, the two flame extinguishing end portions 20*e* are joined to the operating ends 74*d* at a location so that the flame extinguishing end portions 20*d* extend to both above the connecting location at 76*d* and also a short distance below that location 76*d*.

Figure 13:
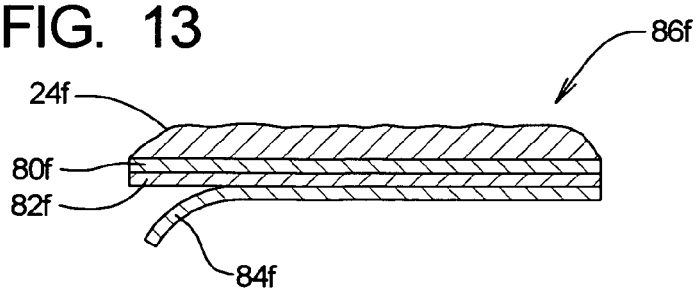
FIG. 13 is a sectional view illustrating a unit of a seventh embodiment where a replacement layer of the flame extinguishing material is provided as a unit which can be adhesively applied to the flame extinguishing surface region of the apparatus.

A seventh embodiment of the present invention is shown in FIG. 13. As indicated earlier in this text, after the layer 24 of the flame extinguishing material is depleted, it can be replaced. Also, as indicated earlier, this could be done by dissolving the depleted material layer 24 and replacing the material by applying a fresh layer of the liquid viscous material onto the flame extinguishing surface portions 22.

An alternative configuration is shown in FIG. 13, where there is shown a layer 24*f* of the flame extinguishing material that has its back surface adhering to a layer 80*f* that extends along the entire back surface of the layer 24*f*. This layer 80*f* could be more rigid or could be made of a fabric. An adhesive layer 82*f* is applied to the downwardly facing surface of the layer 80*f*, and then a protective cover layer 84*f* is placed over the adhesive layer 82*f*.

It can readily be seen from the above description that the embodiment FIG. 13 is a pre-made replaceable unit which is given the general designation 86*f*. To utilize this replacement unit 86*f*, let us assume that the depleted layer 24 has been removed from the flame extinguishing surface regions 22. The unit 86*f* is used by removing the protective cover 84*f* so as to expose the adhesive layer 82*f*, and then the unit 86*f* is applied to the flame extinguishing surface region 22.

It is evident that various modifications could be made to the present invention without departing from the basic teachings thereof.

What is claimed is:

1. A candle flame extinguishing apparatus comprising:

a) a positioning section;

b) an extinguishing section comprising first and second extinguishing members, each of which has a flame extinguishing surface region at which there is a flame extinguishing material which is characterized in that the flame extinguishing material produces a flame extinguishing gaseous substance when in proximity to heat of a flame of a candle;

c) said extinguishing members being mounted to the positioning section so as to be movable relative to one another between a first pre-operating position where the flame extinguishing surface regions are spaced further from one another, and a second operating position where the two flame extinguishing surface regions are facing one another sufficiently close to one another to define an effective flame extinguishing region between the first and second flame extinguishing surface regions; and d) said flame extinguishing material comprises a bicarbonate ingredient and a bonding agent, and said flame extinguishing material yields carbon dioxide as the flame extinguishing gaseous material.

2. The apparatus as recited in claim 1, wherein said positioning section comprises first and second arm members, having first and second end portions, respectively, at which the first and second extinguishing members are located, said arm members being arranged so that in the first pre-operating position, said arm members are moveable manually to position the two first and second extinguishing members closer to one another and in proximity to one another so as to define the flame extinguishing region.

3. The apparatus as recited in claim 2, wherein said two arm members are connected to one another at a connecting location, and said two arm members move relative to one another about said connecting location.

4. The apparatus as recited in claim 3, wherein the flame extinguishing surface region of the two arm members each have a flame extinguishing alignment axis positioned and oriented so that with the two flame extinguishing surface regions in the second operating position, the flame extinguishing alignment axis of the two flame extinguishing surface regions is in vertical alignment with the flame of the candle.

5. The apparatus as recited in claim 4, wherein a vertical dimension of the two flame extinguishing surface regions with the flame extinguishing material thereon, has a lengthwise dimension along the flame extinguishing alignment axis of at least one-half inch.

6. The apparatus as recited in claim 5, wherein said lengthwise dimension is at least about one inch.

7. The apparatus as recited in claim 5, wherein the flame extinguishing surface regions each have a lateral axis perpendicular to the flame extinguishing alignment axis, and have a lateral dimension of at least about one-quarter inch.

8. The apparatus as recited in claim 6, wherein the lateral axis dimension is at least about one-half inch.

9. The apparatus as recited in claim 3, wherein said first and second arm members are connected to one another at an end location which is opposite to an end location which is opposite to an end location at which the first and second extinguishing members are located, said positioning section having a hand gripping portion which comprises intermediate arm portions of the first and second arm members that are located between opposite end portions of the first and second arm members.

10. The apparatus as recited in claim 3, wherein said first and second arm members are connected to one another at an intermediate pivot location with said arm members being moveable relative to one another in a scissors configuration where a hand gripping portion of the positioning section comprises end portions of the first and second arm members that is opposite to a location of the first and second extinguishing members.

11. The apparatus as recited in claim 1, wherein said positioning section has a hand gripping portion which comprises a pistol grip with an actuating trigger, with said actuating trigger being moveable and interconnected with the first and second extinguishing members to move the extinguishing members between the pre-operating position and the operating position.

12. The apparatus as recited in claim 1, wherein said carbonate ingredient comprises a component selected of a group consisting of sodium bicarbonate, potassium bicarbonate, calcium carbonate, potassium carbonate, and combinations thereof.

13. The apparatus as recited in claim 12, wherein said carbonate ingredient comprises at least in part sodium bicarbonate.

14. The apparatus as recited in claim 1, wherein said bonding agent comprises polyvinyl acetate.

15. The apparatus as recited in claim 14, wherein said bonding agent comprises propylene glycol.

16. The apparatus as recited in claim 1, wherein said flame extinguishing material comprises sodium bicarbonate and propylene glycol.

17. A method of extinguishing a candle flame comprising:

a) providing a positioning section having a hand gripping portion;

b) providing an extinguishing section comprising first and second extinguishing members, each of which has a flame extinguishing surface region;

c) positioning on each of said flame extinguishing surface regions a layer of a flame extinguishing material which comprises a bicarbonate ingredient and bonding agent and which yields carbon dioxide a flame extinguishing gaseous substance when in proximity to heat of a flame of a candle;

d) interconnecting said extinguishing members to the positioning section so as to be movable in response to operation of said hand gripping portion;

e) positioning the extinguishing members in a first pre-operating position where the flame extinguishing surface regions are spaced further from one another;

f) operating the hand gripping portion to move the extinguishing members to a second operating position where the two flame extinguishing surface regions are facing one another and are sufficiently close to the candle flame to create an effective flame extinguishing region between the first and second flame extinguishing surface regions to cause the gaseous substance to be produced to extinguish the candle flame.

18. The method as recited in claim 17, wherein said carbonate ingredient comprises a component selected of a group consisting of sodium bicarbonate, potassium bicarbonate, calcium carbonate, potassium carbonate, and combinations thereof.

19. The method as recited in claim 18, wherein said carbonate ingredient comprises at least in part sodium bicarbonate.

20. The method as recited in claim 17, wherein said binding agent comprises polyvinyl acetate, propylene glycol or a combination thereof.

* * * * *